United States Patent [19]

Nakayama

[11] Patent Number: 4,754,620

[45] Date of Patent: Jul. 5, 1988

[54] DYEING APPARATUS

[75] Inventor: Kiyoshi Nakayama, Kurobe, Japan

[73] Assignee: Yoshida Kogyo K. K., Tokyo, Japan

[21] Appl. No.: 947,648

[22] Filed: Dec. 30, 1986

[30] Foreign Application Priority Data

Dec. 30, 1985 [JP] Japan ..... 60-204305[U]

[51] Int. Cl.[4] ..... D06B 5/18

[52] U.S. Cl. ..... 68/62; 68/189

[58] Field of Search ..... 68/62, 150, 189, 149, 68/187, 188, 205 R, 206; 134/148, 152, 153, 166 R, 170, 200

[56] References Cited

U.S. PATENT DOCUMENTS 3,916,653 11/1975 West et al. ..... 68/189 X

FOREIGN PATENT DOCUMENTS 108345 7/1917 United Kingdom ..... 68/205 R 1447857 9/1976 United Kingdom ..... 68/150

*Primary Examiner*—Philip R. Coe

*Attorney, Agent, or Firm*—Hill, Van Santen, Steadman & Simpson

[57] ABSTRACT

A low-liquor-ratio dyeing apparatus comprising a perforated cylindrical beam rotatably supported within a horizontal vessel for supporting on its periphery materials to be dyed, a liquid flow circulation system for forcing dying liquid through the materials radially outwardly of the beam, a sprinkler chamber mounted on the ceiling of the vessel for spraying the liquid over the upper portion of the beam, the ceiling of the vessel, and inner side walls of the vessel, and a liquid supply bypass pipe branched from the supply side of the circulation system and connected to the sprinkler chamber.

2 Claims, 2 Drawing Sheets

DYEING APPARATUS

BACKGROUND OF THE INVENTION

1. Field of the Invention

The present invention relates to an apparatus for dyeing elongate textile materials under high pressure at high temperature, the textile materials being wound on a perforated cylindrical beam, and more particularly to such apparatus suitable for the dyeing treatment at low liquor ratio.

2. Description of the Prior Art

There are known a variety of dyeing apparatus for forcing dyeing liquid into and through elongate textile materials, such as yarns, tapes and fabrics, under high pressure at high temperature as the textile materials is wound on a rotating perforated cylindrical tube commonly known as "beam". The beam is supported concentrically within a cylindrical vessel. The dyeing liquid is forced, under high pressure and at high temperature, to penetrate layers of the textile materials radially outwardly from the inside of the beam on which the textile materials are wound. Difficulty has been experienced with many of the conventional apparatus in securing uniformity of dyeing treatment in all portions of the materials often resulting in different shades or hues both radially and axially of the roll of materials.

To eliminate this treatment defects, an improved apparatus has been proposed in Japanese Patent Post-Examination Publication No. 58-5301, Japanese Patent Post-Examination Publication No. 60-39786 and Japanese Utility Model Post-Examination Publication No. 59-9034, for example. In the prior apparatus, the dyeing liquid surface under which a lower portion of the roll of the materials is soaked is maintained so that the occurrence of different shades and hues due to the non-uniform amount of the dyeing liquid passing through the layers of the materials via the peirpheral holes of the beam, can be prevented.

However, in the case where the amount of textile materials wound on the beam is reduced, namely, the diameter of the roll of the materials is reduced, it is necessary to increase the amount of dyeing liquid, thus causing a remarkable change of the low liquor ratio. Consequently, dyeing conditions, compositions of the dyeing liquid for example, must be adjusted, which is scrupulous. Yet this scrupulous adjustment could not recover the low liquor ratio.

Further, if the dyeing liquid level in the treatment vessel is lowered, a large portion of the layers of the textile materials wound on the beam is necessarily exposed to air in the vessel. Partly because of this large exposed portion of the textile materials to air, and partly because of the non-uniformity of the amount of the dyeing liquid penetrating the materials from the inside thereof, the textile materials can be insufficiently wetted locally. Even though the textile materials is soaked at the lower portion of the beam, non-uniform dyeing is inevitable.

In addition, partly because a small amount of dyeing liquid is jetted out along the inner surfaces of opposite side rims of the beam and is struck thereagainst to scatter, and partly because bubbles are developed on the liquid surface due to the surface active agent as an additive, the dyeing liquid is attached to the wall surface of the vessel which wall surface is exposed to air, so that dyes and assistants contained in the liquid become cohered. Also, the low-molecular-weight materials eluted from the textile materials containing synthetic resin and synthetic fibers are attached to the wall surface of the vessel to become cohered. This cohesion of the dyes and assistants as well as the low-molecular-weight materials makes the wall surface of the vessel dirty. Further, these cohered materials easily fall on the textile materials to stick thereto, thus impairing the dyeing of the textile materials.

SUMMARY OF THE INVENTION

It is therefore an object of the present invention to provide a low-liquor-ratio dyeing apparatus which materials can be dyed efficiently and neatly without causing any problem during the treatment at high temperature.

Another object of the invention is to provide a low-liquor-ratio dyeing apparatus in which a varying amount of materials can be dyed at a required low liquor ratio without difficulty. Therefore this apparatus is particularly suitable for dyeing many kinds of materials each in small quantity.

According to the present invention, a low-liquor-ratio dyeing apparatus comprises a perforated cylindrical beam rotatably supported within a horizontal vessel for supporting on its periphery materials to be dyed, a liquid flow circulation system connected to the vessel for forcing dyeing liquid through the materials ratially outwardly of the beam, a sprinkler mounted on the ceiling of the vessel and having many openings for spraying the liquid over the top of the beam, the ceiling of the vessel, and the inner side walls of the vessel, and a liquid supply bypass pipe branched from the supply side of the circulation system.

Many other advantages, features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
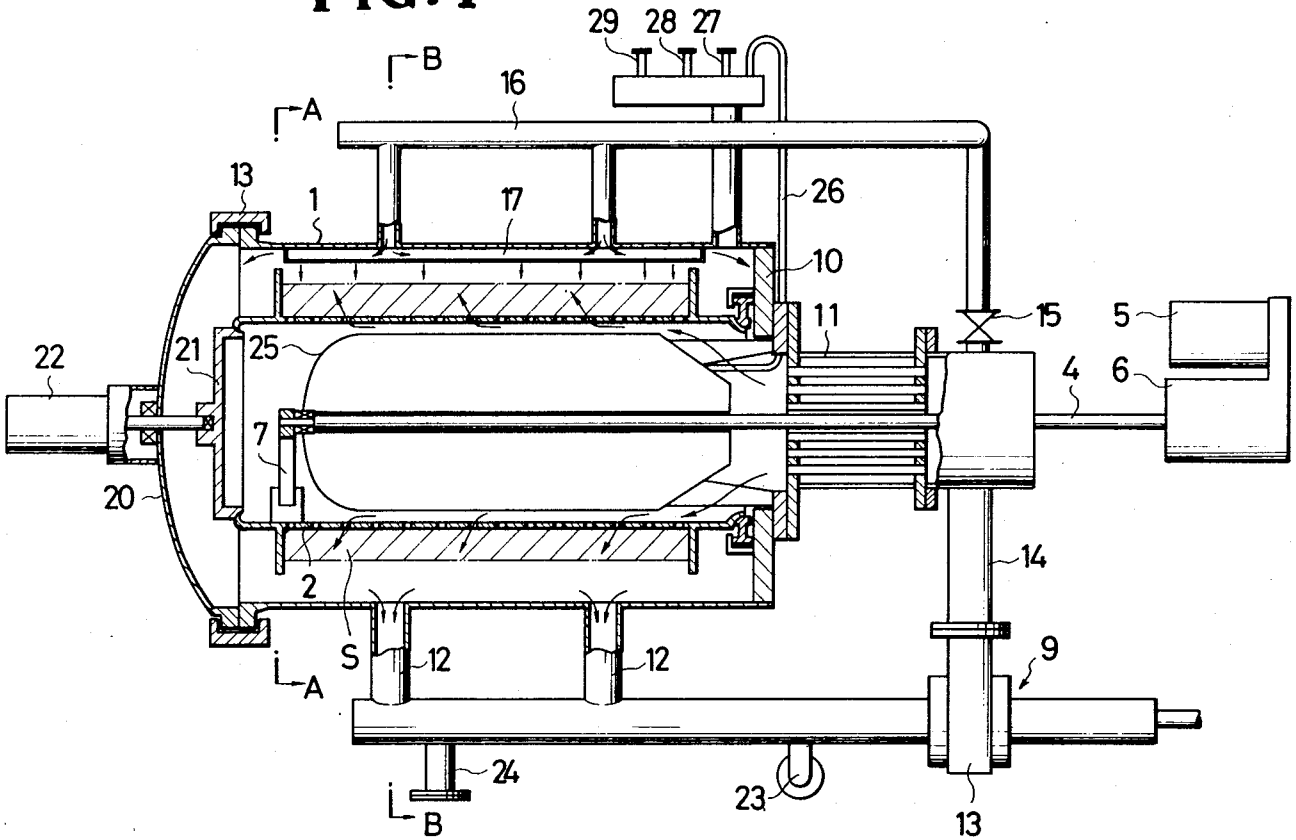
FIG. 1 is a side elevational view, partly in cross section, of a dyeing apparatus embodying the present invention.

FIG. 1 shows a low-liquor-ratio dyeing apparatus for dyeing textile materials S. The apparatus includes a cylindrical vessel 1 having a generally circular cross section (FIGS. 2 and 3) and extending along a generally horizontal axis. The vessel 1 is covered at one or front end tightly by an openable front lid plate 20 and at the other or rear end by an annular rear lid plate 10 to which a heat-exchanger-type heater 11 is attached.

A perforated cylindrical beam 2 having a substantially circular cross section (FIGS. 2 and 3) is supported within the vessel 1 cocentrally thereof. The beam 2 is adapted to support the materials S to be dyed, the materials S being wound on the periphery of the beam 2. The beam 2 has a multiplicity of holes formed in the periphery of the beam and distributed uniformly therearound, allowing the liquid to flow into and through the layers of the materials S wound on the beam 2.

Figure 2:
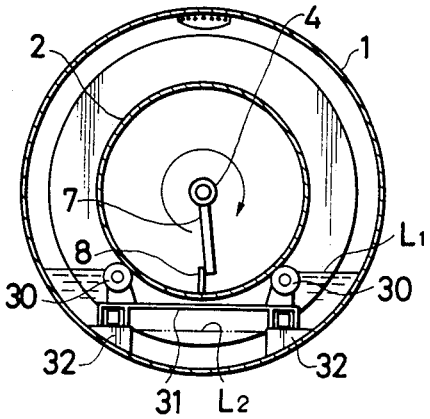
FIG. 2 is a cross-sectional view taken along line A—A of FIG. 1.

As shown in FIG. 2, the beam 2 is supported at each end by a truck 31 movable on and along a pair of parallel spaced rails 32, 32 secured to and extending longitudinally of the vessel 1, the truck 31 having a pair of rollers 30, 30. The beam 5 rests on the two pairs of rollers 30, 30; 30, 30 so that the beam 2 is rotatable about a shaft 4 extending axially thereof. As the beam 2 is rotated clockwise, i.e. in the direction of an allow by a motor 5 via a reducer 6, the rollers 30, 30 roll on the periphery of the beam 2, during which time each roller 30 is rotated counterclockwise.

As shown in FIG. 1, a pusher disk 21 is rotatably mounted on centrally the front lid plate 20 and is axially movable toward and away from the beam 2 by an air cylinder 22, thus closing and opening the front end opening of the beam 2. The peripheral edge of the front lid plate 20 is fluidtightly fastened to the front peripheral edge of the vessel 1 by means of an annular clasp 13.

The apparatus also includes a liquid flow circulation system 9 composed of a pump 13, a main supply pipe 14 communicating with the pump 13 and connected to the heater 11, and a pair of return pipes 12, 12 connected to the bottom portion of the vessel 1 and communicating with the pump 13.

Most important, a liquid supply bypass pipe 16 is branched from the main supply pipe 14 and opens to a sprinkler chamber 17 mounted on the ceiling of the vessel 1 and extending longitudinally thereof. A valve 15 is mounted in the supply bybass pipe 16 for regulating the amount of liquid flowing to the sprinkler chamber 17. A heat-exchanger-type heater may be connected to the supply bypass pipe 14 as desired.

Figure 3:
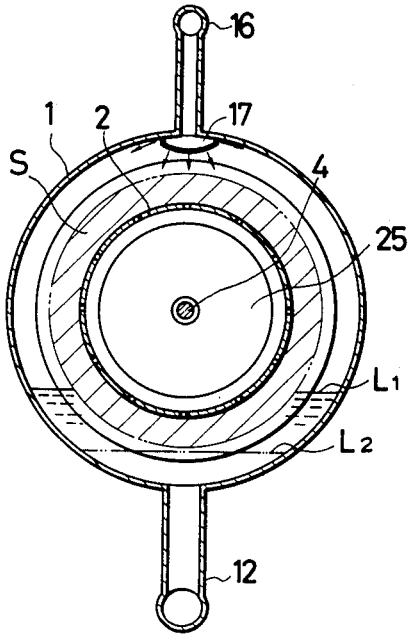
FIG. 3 is a cross-sectional view taken along line B—B of FIG. 1.
Figure 4:
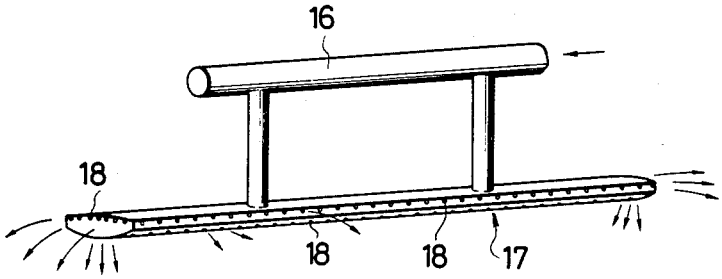
FIG. 4 is a perspective view of a sprinkler chamber.

As better shown in FIGS. 3 and 4, the sprinkler chamber 17 has a multiplicity of openings 18 distributed thereover for spraying the liquid over the upper portion of the beam 2, the ceiling of the vessel 1, and the front and rear lid plates 20, 10 of the vessel 1, as indicated by arrows.

As shown in FIGS. 1 and 2, a drive arm 7 is fixedly mounted on the distal front end of the shaft 4 and extends radially outwardly and terminates short of the inner surface of the beam 2. The beam 2 has a projection 8 mounted on the inner surface of the beam 2 for engagement with the free end of the drive arm 7. Thus the rotation of the shaft 4 is transmitted to the beam 2.

Designated by the numeral 25 is an elongate dummy cylinder supported within the vessel 1 concentrically thereof in order to reduce the volume within the vessel 1 and communicating with the air at the upper portion of the vessel 1 via a pressure equalizing pipe 26. 27 designates a safety valve, 28 a pressure gage and 29 a deaerator, respectively connected to the top of the vessel 1.

The pum 13 of the liquid flow circulation system 9 is operatively connected to a motor (not shown) via a suitable reducer (not shown) such as a frequency converter for regulating the amount of the liquid flow. Connected to the return pipes 12, 12 are a water-suction and medical-liquid-injection pipe 23, and a drainage pipe 24.

The heater 11 may be connected to the return pipes 12, 12 instead of the inlet side of the vessel 1.

In operation, as shown in FIGS. 2 and 3, with the liquid surface maintained at a level $L_1$ where only a limited portion of the layers of the textile materials S is soaked in the liquid, or even at a level $L_2$ where most of the layers of the textile materials S are remote from the liquid surface and hence are not soaked in the liquid, the liquid is forced into and through the layers of th textile materials S radially outwardly, while the outer surface of the textile materials S which surface is exposed to the air within the vessel 1 is covered with a thin layer of the liquid as sprayed from the sprinkler chamber 17. Thus the textile materials S can be adequately wetted throughout the layers, irrespective of the level of the liquid surface. At the same time, the ceiling of the vessel 1, and the inner side walls of the vessel 1 are also covered with a layer of the liquid as sprayed from the sprinkler chamber 17, so that the lowering of the temperature of the materials and parts can be prevented. During that time by the jetted liquid, the foreign matter is prevented from being struck to the materials and parts to cohesion. Consequently with the apparatus, low-liquor-ratio dyeing can take place efficiently and neatly.

Following are the results of experiments conducted under the direction of the inventor:

In the prior dyeing apparatus, for dyeing 40 kg of slide fastener chain (including tapes of polyester fibers and fastener elements of polyester or nylon) on the beam with 850 l of dye liquid, the amount of circulated liquid must be 30 l/s, while the rotation of the pump must be 3,500 r.p.m.

On the other hand, in the present apparatus, the same amount of slide fastener chain was dyed with 400 l of dyeing liquid, where the amount of circulated liquid was 18 l/s as the rate of rotation of the pump was reduced to 2,000 r.p.m., where of 18 l/s, 2 l/s (about a tenth) of the liquid were sprayed from the sprinkler chamber, where the liquid surface in the vessel were kept at the level $L_2$ of FIGS. 1 and 2, and where the rate of rotation of the beam was 3 to 4 r.p.m. As a result, the amount of dye and assistants, the amount of vapor, and the amount of operating power were saved or reduced by about 20%, about 50% and about 50% respectively. And good dyeing was achieved.

Secondly, in the same apparatus of the present invention, 25 kg of fastener chain were dyed with 300 l of dyeing liquid, where the rate of rotation of the pump was reduced 15,000 r.p.m., where the amount of circulated liquid were 10 l/s, where of 10 l/s, 1.7 l/s of liquid were sprayed from the sprinkler chamber, and where the liquid surface were kept at the level $L_1$ of FIGS. 1 and 2. As a result, like in the first experiment, good dyeing was achieved.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A low-liquor-ratio dyeing apparatus for dyeing textile materials with dyeing liquid comprising:

(a) a horizontally extending cylindrical vessel for containing the dyeing liquid, said cylindrical vessel having an inner periphery constituting its ceiling and opposed inner side walls perpendicular to the horizontal axis of said cylindrical vessel, (b) a perforated cylindrical beam rotatably supported concentrically within said vessel for supporting the textile material to be dyed on said beam, (c) a liquid flow circulation system for forcing dyeing liquid into the interior of said beam so as to pass through the textile materials radially outwardly, (d) a sprinkler chamber supported from said ceiling of said vessel and having a multiplicity of openings arranged to spray dyeing liquid onto an upper portion of said beam, onto said ceiling, and onto said opposed inner side walls, and (e) a liquid supply conduit connected to said circulation system for delivering dyeing liquid into said sprinkler chamber.

2. A low-liquor-ratio dyeing apparatus according to claim 1, said sprinkler chamber extending longitudinally along the effective length of said beam.

* * * * *